US010508432B2

(12) United States Patent
Theriot

(10) Patent No.: US 10,508,432 B2
(45) Date of Patent: Dec. 17, 2019

(54) CONNECTION FOR STACKING POST SYSTEM FOR MULTISTORY BUILDING CONSTRUCTION

(71) Applicant: SS-20 BUILDING SYSTEMS, INC., Bradenton, FL (US)

(72) Inventor: Chris Theriot, Sarasota, FL (US)

(73) Assignee: SS-20 BUILDING SYSTEMS, INC., Bradenton, FL (US)

( * ) Notice: Subject to any disclaimer, the term of this patent is extended or adjusted under 35 U.S.C. 154(b) by 0 days.

(21) Appl. No.: 15/960,748

(22) Filed: Apr. 24, 2018

(65) Prior Publication Data

US 2019/0323223 A1 Oct. 24, 2019

(51) Int. Cl.

| | |
|---|---|
| ***E04B 1/24*** | (2006.01) |
| ***E04C 3/32*** | (2006.01) |
| ***E04B 1/41*** | (2006.01) |

(52) U.S. Cl.

CPC ..... *E04B 1/2403* (2013.01); *E04B 1/40* (2013.01); *E04C 3/32* (2013.01); *E04B 2001/246* (2013.01); *E04B 2001/2421* (2013.01); *E04B 2001/2448* (2013.01); *E04B 2001/2466* (2013.01); *E04B 2103/06* (2013.01)

(58) Field of Classification Search

CPC .. E04B 1/2403; E04B 1/40; E04B 2001/2421; E04B 2001/2448; E04B 2001/246; E04B 2001/2466; E04B 2103/06; E04C 3/32

See application file for complete search history.

(56) References Cited

U.S. PATENT DOCUMENTS

| | | | | |
|---|---|---|---|---|
| 7,412 A * | 6/1850 | Fisher | F16C 3/02 | 464/183 |
| 225,060 A * | 3/1880 | Johnson | E04B 1/2604 | 403/174 |
| 1,581,487 A * | 4/1926 | Kohler | E04B 1/2403 | 52/653.2 |

(Continued)

FOREIGN PATENT DOCUMENTS

WO WO-2017146839 A1 * 8/2017 ..... E04B 1/1909

OTHER PUBLICATIONS

"Steel Construction: A manual for architects, engineers and fabricators of buildings and other steel structures", American Institute of Steel Construction, 1947, 5th edition, New York.

*Primary Examiner* — James M Ference

(74) *Attorney, Agent, or Firm* — Gardner Groff & Greenwald, PC

(57) ABSTRACT

A first post has a lower portion at a first floor of a multistory building and an upper portion at a second floor, and a second post has a lower portion at the second floor and an upper portion at a third floor or building-top structure. A post connection includes a horizontal cap plate and a vertical sleeve extending upward from the cap plate and having a bore with an inner dimension. The cap plate attaches to and covers the first post upper portion to prevent water intrusion into the first post. The second post lower portion has an outer dimension that is slightly less than the connection sleeve inner dimension so that the second post lower portion is slidingly received in the connection sleeve bore in an overlapping, telescopic arrangement. A retainer may be installed for engaging and supporting the second post on the connection.

18 Claims, 5 Drawing Sheets

(56) References Cited

U.S. PATENT DOCUMENTS 3,017,723 A * 1/1962 Von Heidenstam ..... E04B 1/3511 249/18
3,058,264 A * 10/1962 Varlonga ..... E04B 1/2403 52/236.9
3,110,982 A * 11/1963 Besinger ..... B28B 23/02 52/301
3,145,811 A * 8/1964 Strehan ..... E04B 1/943 52/1
3,254,466 A * 6/1966 Von Heidenstam ..... E04B 1/3511 264/31
3,260,028 A * 7/1966 Lee ..... E04B 1/3404 52/125.1
3,355,853 A * 12/1967 Wallace ..... E04B 1/35 264/33
3,713,265 A * 1/1973 Wysocki ..... E04B 1/3511 52/125.1
3,783,565 A * 1/1974 Hughes ..... E04B 1/215 52/127.1
3,793,794 A * 2/1974 Archer ..... E04H 12/12 52/115
3,978,630 A * 9/1976 Labie ..... E04B 1/3404 52/236.6
4,074,487 A * 2/1978 Daniels ..... E04B 1/24 52/236.3
4,099,360 A * 7/1978 Outram ..... E02D 5/523 52/126.7
4,173,853 A * 11/1979 Logan ..... E04H 12/00 52/301
4,211,045 A * 7/1980 Koizumi ..... E04B 1/21 52/251
4,221,092 A * 9/1980 Johnson ..... F16L 5/04 52/1
4,272,929 A * 6/1981 Hanson ..... E02D 27/42 52/40
4,346,540 A * 8/1982 Anderson ..... E04B 1/24 211/182
4,722,156 A * 2/1988 Sato ..... E04C 3/34 52/834
4,785,593 A * 11/1988 Munoz, Jr. ..... E02D 27/42 52/126.1
5,012,622 A * 5/1991 Sato ..... E02D 5/30 52/263
5,038,544 A * 8/1991 Traut ..... E04F 21/28 52/698
5,182,884 A * 2/1993 Tarics ..... E04B 1/0023 52/220.2
5,320,439 A * 6/1994 Perrault ..... F16L 3/22 248/58
5,444,957 A * 8/1995 Roberts ..... E04B 5/40 52/236.8
5,507,124 A * 4/1996 Tadros ..... E04B 5/43 52/251
5,678,375 A * 10/1997 Juola ..... E04B 1/24 52/655.1
5,687,537 A * 11/1997 Noble ..... H01Q 1/1242 52/849
5,737,895 A * 4/1998 Perrin ..... E04B 1/165 52/236.8
5,809,712 A * 9/1998 Simanjuntak ..... E04C 5/08 52/223.7
6,151,851 A * 11/2000 Carter ..... E04B 1/24 52/236.3
6,874,287 B2 * 4/2005 Felser ..... E04B 1/2403 52/251
7,007,431 B2 * 3/2006 Schubert ..... E04B 1/24 52/263
7,028,435 B2 * 4/2006 Walker ..... E04B 1/24 52/236.5
7,037,030 B2 * 5/2006 McLemore ..... E01F 13/048 404/6
8,011,147 B2 * 9/2011 Hanlan ..... E04B 1/20 52/236.3
8,468,775 B2 * 6/2013 Vaughn ..... E02D 27/34 403/200
8,516,776 B2 * 8/2013 Pan ..... E04B 1/945 52/236.3
9,523,188 B2 * 12/2016 Rahimzadeh ..... E04B 1/30
2004/0221521 A1 * 11/2004 Schubert ..... E04B 1/24 52/169.9
2007/0079567 A1 * 4/2007 Leslie ..... E04B 1/24 52/297
2008/0053020 A1 * 3/2008 Collins ..... E04B 1/24 52/282.4
2008/0178551 A1 * 7/2008 Porter ..... E04B 1/24 52/653.1
2010/0071305 A1 * 3/2010 Collins ..... E04B 1/24 52/704
2014/0000207 A1 * 1/2014 Rahimzadeh ..... E04B 1/1903 52/650.3
2015/0068138 A1 * 3/2015 Rubel ..... E04C 5/16 52/98
2016/0032580 A1 * 2/2016 Rahimzadeh ..... E04B 1/30 52/236.9
2016/0090729 A1 * 3/2016 Takahashi ..... E04B 1/2403 52/698
2017/0044753 A1 * 2/2017 Bowron ..... F16B 7/00
2017/0233995 A1 * 8/2017 Abernathy ..... F16B 7/182 52/845
2017/0233996 A1 * 8/2017 Abernathy ..... E04B 1/2403 52/698

* cited by examiner

CONNECTION FOR STACKING POST SYSTEM FOR MULTISTORY BUILDING CONSTRUCTION

TECHNICAL FIELD

The present invention relates generally to the construction of buildings with multiple stories, and more particularly, to a system and method of coupling together vertical posts for supporting the building floors.

BACKGROUND

Multistory steel-framed buildings are sometimes constructed with a stackable support column system and method including vertical columns or posts with telescopic connections for assembly in a stacking arrangement. This stacking-column arrangement is described in U.S. Pat. No. 6,151,851 to Carter, which is hereby incorporated herein by reference. While this system represents a pioneering step forward over previous construction systems, there remains an opportunity for improvement. In particular, water can intrude into the hollow posts or columns and drain by gravity all the way to the bottom of the bottom post, and weep or drain holes formed into the posts adjacent their bottoms can become clogged (or drilling them can be overlooked). In such cases, a significant column of water can accumulate, which can freeze in cold weather with the resulting expansion damaging the posts and compromising their structural integrity such that they must be replaced. Also, the accumulated water can cause flooding of the bottom floor upon unclogging of the weep holes.

Accordingly, it can be seen that needs exist for improvements in connections for stacking support post systems and methods for multistory building construction. It is to the provision of solutions to this and other problems that the present invention is primarily directed.

SUMMARY

Generally described, the present invention relates to an improved connection for vertical support posts or columns of a stackable support post arrangement for constructing a multistory building. Typically the building includes at least three levels (e.g., three floors, or two floors and a building top) and each level includes a plurality of posts, but for explanatory purposes only two posts will be described in this summary.

In example embodiments, a first post has a lower portion at the first floor of the multistory building and an upper portion at the second floor, and a second post has a lower portion at the second floor and an upper portion at the third floor or building-top structure. A post connection includes a horizontal cap plate and a vertical sleeve extending upward from the cap plate and having a bore with an inner dimension. The cap plate attaches to and covers the first post upper portion to prevent water intrusion into the first post. The second post lower portion has an outer dimension that is slightly less than the connection sleeve inner dimension so that the second post lower portion is slidingly received in the connection sleeve bore in an overlapping, telescopic arrangement. A retainer may be installed for engaging and supporting the second post on the connection.

The specific techniques and structures employed to improve over the drawbacks of the prior systems and accomplish the advantages described herein will become apparent from the following detailed description of example embodiments and the appended drawings and claims.

DETAILED DESCRIPTION OF EXAMPLE EMBODIMENTS

Figure 1:
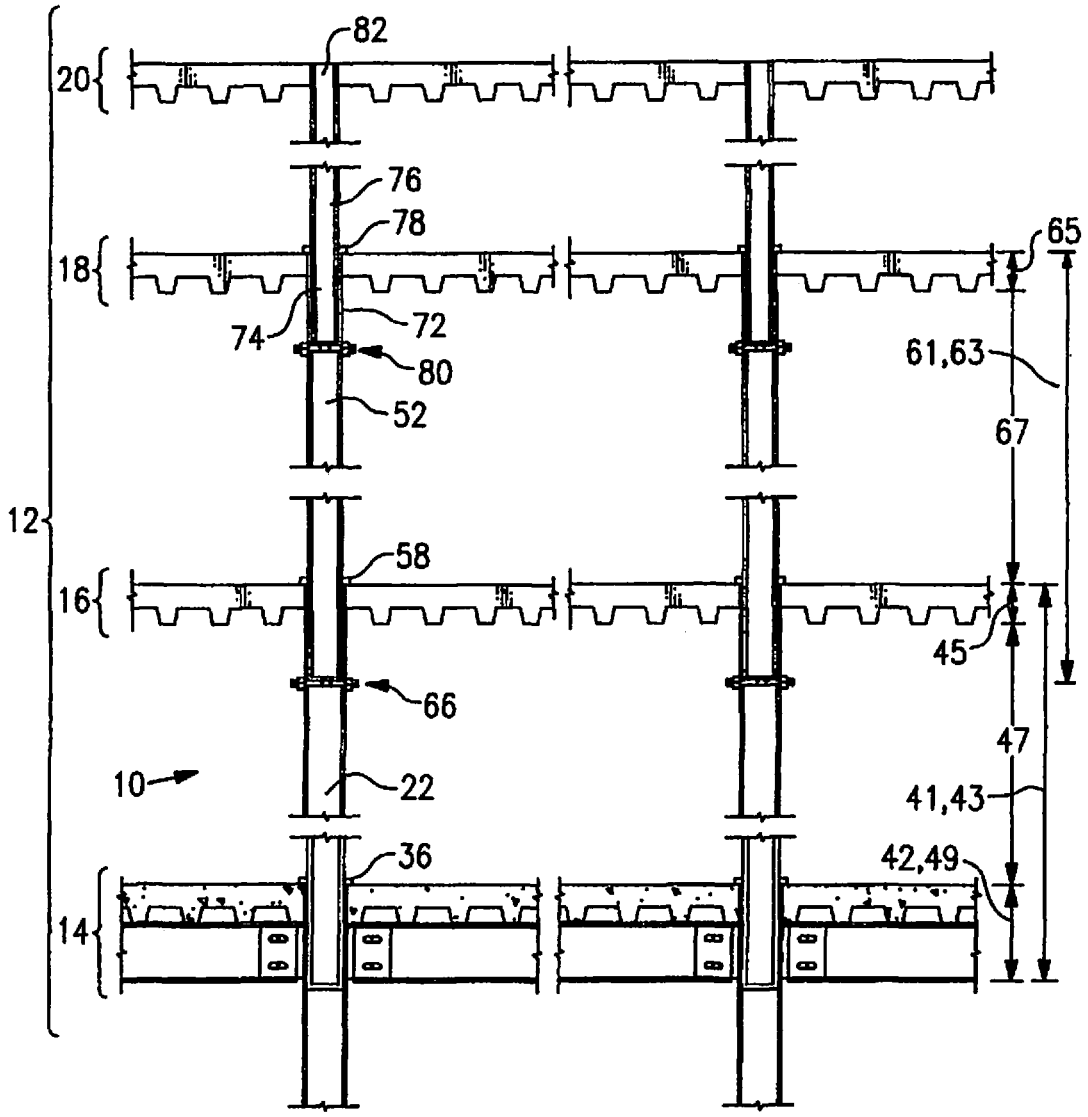
FIG.1 Prior Art
FIG. 1 is an elevation view of a portion of a multistory building constructed of a system of stackable support columns or posts, shown in cross section, according to a first example embodiment of the present invention.

Referring now to FIGS. 1-4, there is illustrated a first example embodiment of the present invention, referred to generally as 10. Referring to FIG. 1, there is provided a stackable support column apparatus 10 for constructing a multistory building 12. For purposes of illustration only, the apparatus 10 will be described with reference to the construction of a three story building 12 comprising a first floor 14, a second floor 16, a third floor 18, and at building top structure 20. The first floor 14 may be constructed in any number of ways such as by a concrete slab or by other constructions known to those skilled in the art. The second 16 and third 18 floors may be constructed in any number of ways such as by joists with metal, wood, concrete, composite, or other light-weight decking laid thereon or by other constructions known to those skilled in the art. The building top structure 20 may be constructed in any number of ways such as an attic floor, a building roof, or in other constructions known to those skilled in the art. It will be understood that the apparatus 10 may be suitably employed in other building constructions having other numbers and arrangements of building floors, such as including a fourth floor and higher floors and/or including one or more sublevel floors (e.g., a basement), as desired in a given building design. Also, the apparatus 10 may be suitably employed in the construction of residential, commercial, industrial, or other buildings.

Figure 2:
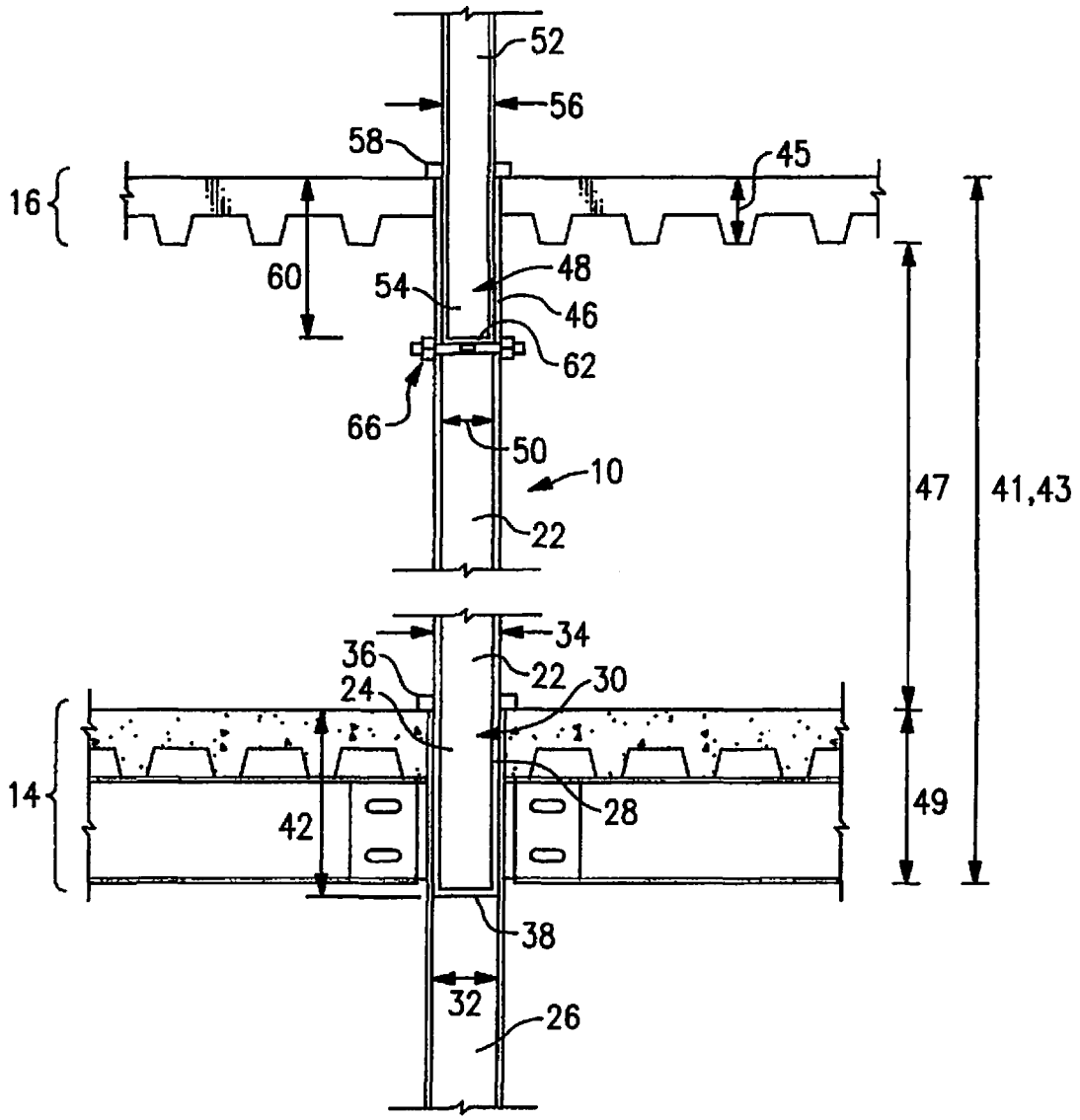
FIG.2 Prior Art
FIG. 2 shows portions of a first column and a second column of the building portion of FIG. 1.

Referring additionally to FIG. 2, there is provided at least one and typically a plurality of first column members 22 each having at least a top and bottom portion that is hollow. For example, the first column members 22 can be provided by rectangular steel tubing with a generally uniform cross sectional shape and area along substantially all of their length. Optionally, the first columns 22 may have a circular, hexagonal, octagonal or other regular or irregular shape known to those skilled in the art and along only a portion of its length (e.g., they can have flared-larger bottom and/or top portions/segments for connecting to columns having the same cross-sectional size and shape). Also, the first columns 22 may optionally be constructed of other metals, concrete, wood, composite, or other materials known to those skilled in the art. As used herein, the terms "columns" and "posts" are used interchangeably; although they have slightly different meaning in the art of steel construction, that difference is not relevant to this invention.

Each first column 22 has a lower portion 24 that may be secured to the first floor 14 in any of a number of ways. For example, each first column 22 may be secured to the first floor 14 by at least one base column 26 that is attached to the first floor 14 by bolting, welding, embedding in concrete, brackets, plates, or by other construction methods known to those skilled in the art. Optionally, the first columns 22 may be attached directly to the first floor 14 by bolting, welding, embedding in concrete, brackets, plates, or by other construction methods known to those skilled in the art.

Each base column 26 of the example embodiment can have a construction similar to the first columns 22, for example, they can be made of a rectangular steel tubing with a generally uniform cross sectional shape and area along substantially all of their length but may optionally be provided in other arrangements. Each base column 26 has an upper portion 28 with a bore 30 defined therein with an inner dimension 32. Each first column lower portion 28 has an outer dimension 34 that is substantially the same or less than the inner dimension 32 of the base column upper portion bore 30. Each first column lower portion 24 may thus be slidingly received by any base column upper portion 28 in an overlapping, telescopic arrangement. Accordingly, each first column 22 preferably will have a height 41 corresponding to a first story height 43 which includes a second floor height 45, a height 47 between the second floor 16 and the first floor 14, and at least a portion of a first floor height 49.

Figure 3:
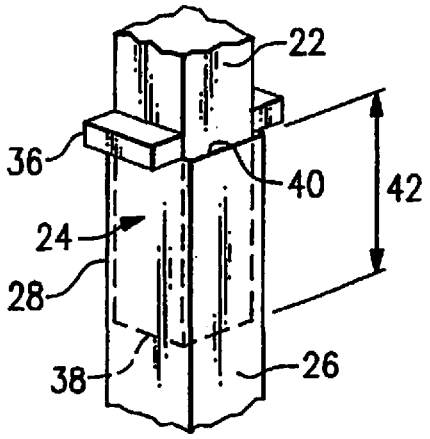
FIG.3 Prior Art
FIG. 3 is a perspective detail view of a retainer arrangement at a lower portion of the first column of FIG. 2.

Referring further to FIG. 3, at least one and typically two base retainers 36 may be provided attached to the first column lower portion 24 by bolting, welding or other techniques known to those skilled in the art. The retainers 36 may be attached to the first column lower portion 24 during fabrication of the first column 22 in the factory or in the field.

The retainers 36 engage a top 40 of the base column upper portion 28 and support the load thereon of the above columns as described hereinbelow. Each base retainer 36 is typically provided by a rectangular steel bar. Optionally, each retainer 36 may be provided by a bracket, plate, or like retainer and may be made of other metals, concrete, wood, composites, or other materials known to those skilled in the art, as selected to support the load of the above columns. The height of the retainers 36 may be further selected so that when installed they provide a screed point for applying a concrete layer to the first floor 14.

The retainers 36 are attached to the first column 22 at a predetermined distance 42 from a bottom 38 of the first column 22, the distance 42 selected to provide an overlap between the first column lower portion 24 and the base column upper portion 28 sufficient to prevent lateral forces on the columns 22 and 26 from bending them, particularly during erection of the columns 22 and 26. In the typical three story building, for example, the distance 42 may be approximately the height 49 of the typical building first floor 14. Optionally, the distance 42 may be greater than the floor height 49 for a building with thinner floors or a greater number of stories, or lesser than the floor height 49 for a building with thicker floors or a lesser number of stories. It has been determined that an overlap distance 42 of about 10% of the column height 41 generally provides good stability and strength without adding undue weight or length, though larger or smaller overlap distances 42 may be suitably employed.

Referring back to FIG. 2, each first column 22 has an upper portion 46 with a construction similar to the base column upper portion 28, that is, the first column upper portion 46 has a bore 48 defined therein with an inner dimension 50. Each first column upper portion 46 may be attached to the second floor 16 by bolting, welding, brackets, plates, or by other construction methods known to those skilled in the art.

At least one and typically a plurality of second columns 52 are provided with each having a construction similar to the first columns 22, that is, each typically made of rectangular steel tubing with a generally uniform cross sectional shape and area along substantially all of its length, though optional arrangements may be suitably employed. Each second column 52 has a lower portion 54 with an outer dimension 56 that is substantially the same or less than the inner dimension 50 of the first column upper portion bore 48. The second column lower portion 54 may thus be slidingly received by the first column upper portion 46 in an overlapping, telescopic arrangement. Accordingly, each second column 52 typically will have a height 61 corresponding to a second story height 63 which includes a third floor height 65, a height 67 between the third floor 18 and the second floor 16, and at least a portion of a second floor height 45. The weight of the second column 52 and the building components thereabove act to hold the column 52 in place.

Figure 4:
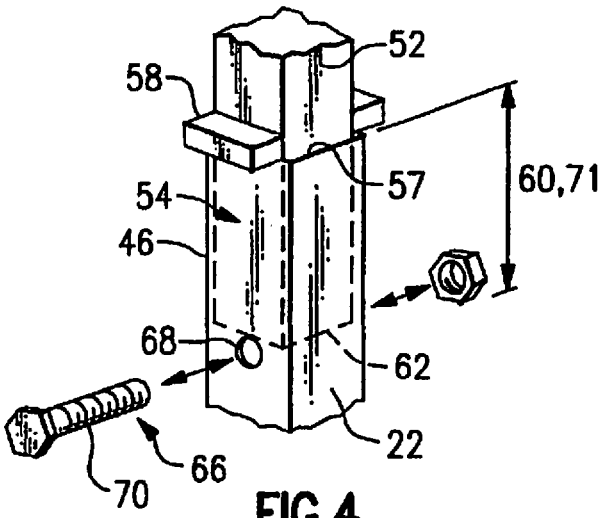
FIG.4 Prior Art
FIG. 4 is a perspective detail view of a retainer arrangement at an upper portion of the first column of FIG. 2.

Referring further to FIG. 4, at least one and typically two first upper retainers 58 may be provided having a construction similar to the base retainers 36, that is, rectangular steel bars, though optional arrangements may be suitably employed. Each retainer 58 is typically attached to the second column lower portion 54 by bolting, welding or other techniques known to those skilled in the art. The retainers 58 engage a top 57 of the first column upper portion 46 and support the load thereon of the above columns.

Similarly to the base retainers 36, the first upper retainers 58 are attached to the second column 52 at a predetermined distance 60 from a bottom 62 of the second column 52, the distance 60 selected to provide a distance of overlap between the second column lower portion 54 and the first column upper portion 46 sufficient to prevent lateral forces on the columns 22 and 52 from bending them. In the typical three story building, for example, the distance 60 may be approximately the height 45 of the typical building second floor 16 (see FIGS. 1-2). Optionally, the distance 60 may be greater than the floor height 45 for a building with thinner floors or a greater number of stories, or less than the floor height 45 for a building with thicker floors or a lesser number of stories.

There may further be provided at least one first lower retainer 66 comprising at least one aperture 68 defined through the first column upper portion 46 and an elongate member 70 that may be received by the aperture 68 to extend through the first column 46 (see FIGS. 1-2). The elongate member 70 is preferably provided by a threaded steel bolt with a correspondingly threaded nut. Optionally, the elongate member 70 may be provided by a pin, dowel, rectangular bar, or other retainer member known to those skilled in the art. The elongate member 70 engages the bottom 62 of the first column upper portion 46 and supports the load thereon of the above columns. It should be noted that the second column lower portion 54 may be provided as a solid member or with a cap attached thereto for distributing the load of the elongate member 70 thereacross.

The aperture 68 of the lower retainer 66 is provided in the second column 52 at a distance 71 from the top 57 of the first column 22, the distance 71 selected for similar purposes as the distance 60, that is, to provide a distance of overlap between the second column lower portion 54 and the first column upper portion 46 sufficient to prevent lateral forces on the columns 22 and 52 from bending them. It will be noted that the lower retainer 66 may be provided in addition to or as an alternative to the upper retainer 58, as desired distribute the load in a given building design.

Referring back to FIG. 1, each second column 52 has an upper portion 72 which may be attached to a building top structure 20 in the case of a two story building by bolting, welding, brackets, plates, or by other construction methods known to those skilled in the art. In the present example of a three story building 12, each upper portion 72 has a construction similar to the first column upper portion 46 for slidably receiving a lower portion 74 of at least one third column member 76. Each third column 76 can have a construction similar to the first and second columns 22 and 52, that is, each is typically made of rectangular steel tubing with a generally uniform cross sectional shape and area along substantially all of its length, though optional arrangements may be suitably employed. At least one second upper retainer 78 and at least one second lower retainer 80 may be provided similarly to the first upper retainer 58 and the first lower retainer 66. Each third column 76 has an upper portion 82 which may be attached to a building top structure 20 such as the attic floor or roof by bolting, welding, brackets, plates, or by other construction methods known to those skilled in the art. Each third column lower portion 74 may thus be slidingly received by the second column upper portion 72 in an overlapping, telescopic arrangement.

In selecting the columns 22, 52 and 76 for the three story building 12 described herein as an example, the number, size, and spacing of the columns 22, 52, and 76 is selected based on the desired structural requirements of the building 12 with consideration to the fact that each ascending column series has a smaller cross sectional area than the columns series immediately therebelow. For example, the first columns 22 may be provided by 4" by 4" square tubular steel, the second columns 52 by 3½" by 3½" square tubular steel, and the third columns 76 by 3" by 3" square tubular steel. Thus, for a building with more than three stories, the columns 22, 52, and 76 may have a larger cross sectional size and/or or a smaller spacing.

Figure 6:
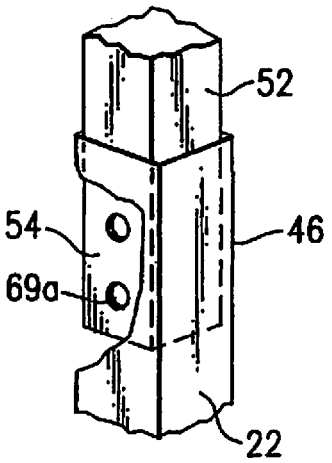
FIG.6 Prior Art
FIG. 6 shows a portion of the retainer arrangement of FIG. 5 with a cutaway portion thereof.
Figure 5:
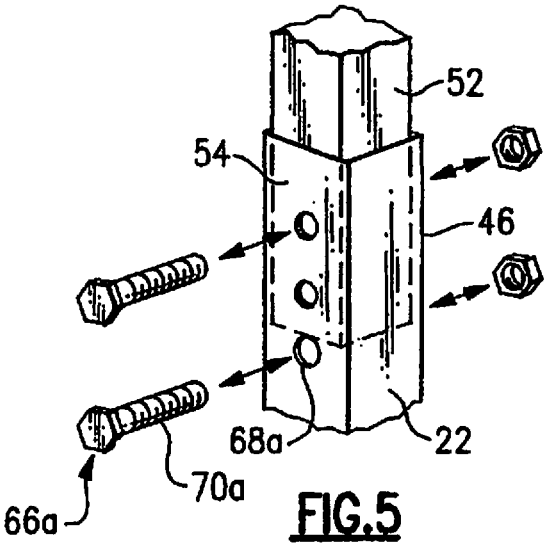
FIG.5 Prior Art
FIG. 5 is a perspective detail view of a retainer arrangement according to a second example embodiment.

Referring now to FIGS. 5-6, in a second example embodiment of the present invention there are provided at least one alternative lower retainer **66*a* comprising a plurality of apertures 68*a* defined through the first column upper portion 46, a plurality of apertures 69*a* defined through the second column lower portion 54 capable of being aligned with the apertures 68*a*, and a plurality of elongate members 70*a* each of which may be received by the aligned apertures 68*a* and 69*a* to extend through the first column 46. The plurality of elongate members 70*a*** provide added points of support for the loaded columns thereabove, fixedly secure the columns in place, and provide flexibility by permitting standardized columns that may be used in different building designs.

It will be noted that various other arrangements of the columns may be suitably employed. For example, each column may be provided in two sections with an overlapping, telescopic portion and retainers similar to those of the example embodiment as described hereinabove. In this arrangement, braces may be added in the interior walls of the building for added lateral support. In another example, a sleeve is fixedly attached over and onto the end of one column for receiving therein the end of another column of similar size. In this arrangement, the sleeve is slid onto and attached to the lower column, and is thus considered to be the top portion of the lower column that receives the lower portion of the upper column in an overlapping, telescopic arrangement. Also, in some embodiments the tubular steel columns may be filled with a material such as a foam, particle matter, concrete, a composite or the like selected for high strength and low weight.

A method of constructing a multistory building in accordance with the invention includes installing the plurality of first column members 22 on the first floor 14. Typically, each first column lower portion 24 is inserted into the bore 30 of the upper portion 28 of the base column 26 which is attached to the first floor 14, and each first column 22 is retained in place and supported by the base retainers 36 attached to the base column upper portion 28. Optionally, each first column lower portion 24 may be attached directly to the first floor 14 as described hereinabove.

Once the desired number of first columns 22 have been installed, the plurality of second columns 52 are then installed by inserting the lower portion 54 of each second column 52 into the bore 48 of the upper portion 46 of a respective one of the first columns 22 so that the second column lower portions 54 and the first column upper portions 46 overlap in a telescopic arrangement. Each second column 22 is retained in place and supported by the first upper 58 and/or lower 66 retainers.

Similarly, the plurality of third columns 76 are then associated with the second columns 52 by inserting the lower portion 74 of each third column 76 into the upper portion 72 of a respective one of the second columns 52 so that the third column lower portions 74 and the second column upper portions 72 overlap in a telescopic arrangement. Each second column 52 is retained in place and supported by the second upper 78 and/or lower 80 retainers. The building top structure 20 is then attached to the upper portions 82 of the third columns 76. Walls and other building components are then installed to complete the building structure.

Figure 7:
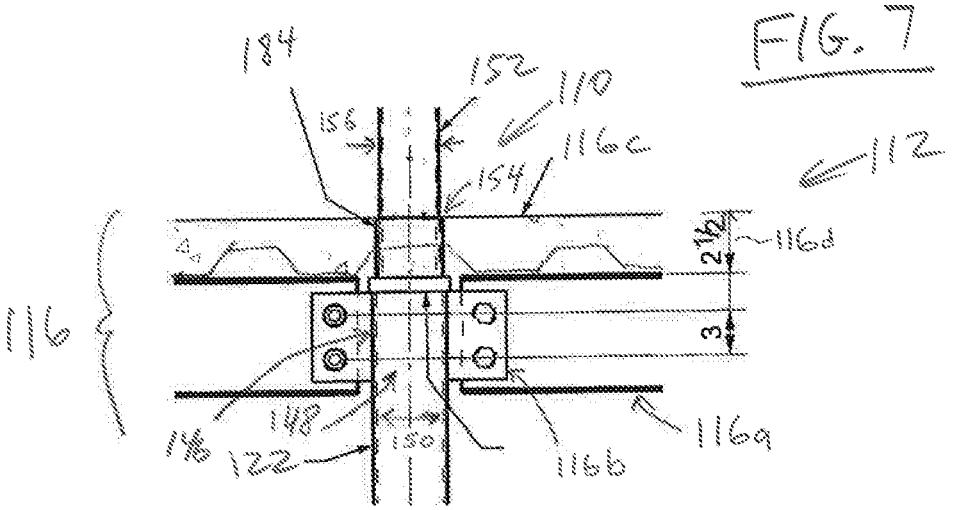
FIG. 7 is an elevation view of a portion of a multistory building constructed of a system of stackable support posts or columns according to a third example embodiment of the invention.
Figure 8:
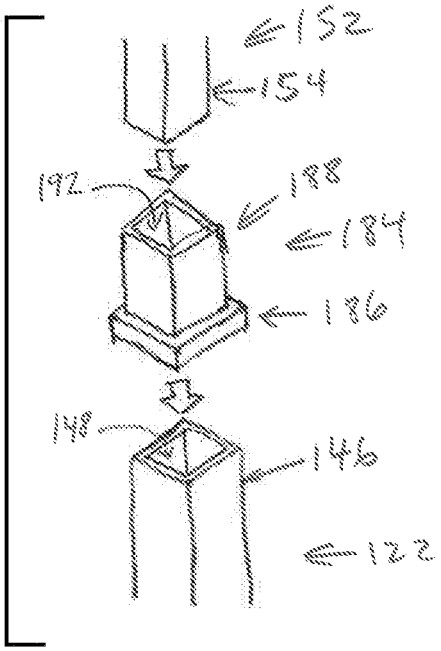
FIG. 8 is an exploded view of portions of a first post and a second post, and a connection therefor, of the building portion of FIG. 7.
Figure 9:
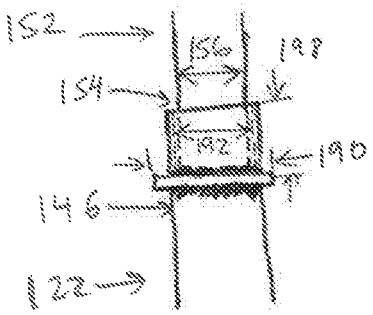
FIG. 9 is an elevation detail view of the assembled posts and connection of FIG. 8.

FIGS. 7-9 show a portion of a multistory building 112 constructed of a stacking post/column system 110 according to a third example embodiment of the present invention. The system 110 of this embodiment is similar to that of the previously described embodiments, with common aspects not repeated for brevity, and with differences explained in detail below. Thus, the multi-story building 112 includes at least three levels (e.g., three floors, or two floors and a building top) and a plurality of posts between each level, but for explanatory purposes only a portion of one floor and portions of two posts are shown in the drawings to illustrate the different connection of the system 110 of this embodiment.

As depicted, the stacking-post system 110 is shown installed with respect to a second floor 116 of a multistory building 112. Each first post 112 has an upper portion 146 at the second floor 116 as well as a lower portion (not shown) at a first floor. Each second post 152 has a lower portion 154 at the second floor 116 as well as an upper portion (not shown) at a third floor or building-top structure (not shown).

The first and second posts 122 and 152 can have a construction similar to the respective columns of the embodiments described above, that is, each is typically made of rectangular steel tubing with a generally uniform cross-sectional shape and area along substantially all of its length, though optional arrangements may be suitably employed. As such, each first-post upper portion 146 typically has a bore 148 with an inner dimension 150 and each second-post lower portion 154 has an outer dimension 156. A third post (not shown) or higher is included for additional stories of the multistory building 110.

Each first post 122 has the second floor 116 attached to it by bolting, welding, brackets, plates, or by other construction methods and fasteners known to those skilled in the art. As depicted, for example, the second floor 116 includes horizontal beams 116*a* that are fixed to the first-post upper portion 146 by plates 116*b*, with a slab of concrete 116*c* installed on top. Other floor constructions can be used as may be desired. A third floor (not shown) or higher is included for additional stories of the multistory building 110.

As described thus far, the stacking-post system 110 of this embodiment is the same or substantially the same as the embodiments described above, as the stacking posts can be the same or substantially the same as those used in the previous embodiments. In this embodiment, however, new connections 184 are provided for connecting together the stacking posts.

Each post connection 184 includes a horizontal cap plate 186 and a vertical telescopic member 188 extending upward from the cap plate. The cap plate 184 is configured with a size and shape selected to cover the bore 148 of the first-post upper portion 146. For example, for a first post 122 having a square shape and a 4" by 4" size, the cap plate 184 can having a square shape and a 5" by 5" size. In any event, for square tubing the cap plate 184 has an outer dimension 190 that is larger (e.g., by 1") than the inner dimension 150 of the first-post upper-portion bore 148.

In this way, when the cap plate 184 is installed, it covers the first-post upper-portion bore 148 and thus prevents water intrusion into the first post 112. So any water that might intrude into the second post 152 above and drain by gravity to the bottom of the second post is thereby isolated and blocked from draining farther downward and into the first post 122. With the same connection 184 used throughout the multistory building 112 on all the floors, any water that might intrude into any third and/or higher post(s) is thus also isolated to that post and prevented from draining all the way to and accumulating at the lower portion of the first post 122.

The cap plate 184 has a construction (e.g., thickness and material selection) for providing the strength needed for supporting the building load from above. In typical embodiments, for example, the cap plate 184 is made of structural steel plating with a 1" thickness. The cap plate 184 can be attached to the top transverse end of the first-post upper portion 146 using conventional construction fasteners and methods known to those skilled in the art, such as welding (as depicted), bolting, brackets, or the like.

The vertical telescopic member 188 that extends upward from the top surface of the cap plate 184 can be provided by a sleeve having a bore 192 with an inner dimension 196 and having a length 198. The sleeve 188 can be provided by a length of a hollow post material for example of the same type as the first and second posts 122 and 152. Typically, the vertical sleeve 188 is provided by a length of rectangular steel tubing with a generally uniform cross-sectional shape and area along substantially all of its length, though optional arrangements may be suitably employed. The connection-sleeve inner dimension 196 is slightly greater than the second-post lower-portion outer dimension 156 so that the second-post lower portion 154 is slidingly received in the connection sleeve bore 192 in an overlapping, telescopic arrangement. In a typical embodiment, for example, the second post 152 can be 3½" (outer dimension) square tubing and the connection sleeve 188 can be 4" (outer dimension) square tubing with a 3/16" wall thickness resulting in a bore inner dimension of 3⅝", which is slightly larger (by ⅛") than the 3½" second-post lower-portion outer dimension 156. The sleeve 188 can be attached to the top surface of the cap plate 186 using conventional construction fasteners and methods known to those skilled in the art, such as welding (as depicted), bolting, brackets, or the like.

The connection-sleeve length 198 is selected to provide an overlap with the first-post lower portion 124 sufficient to prevent lateral forces on the posts 122 and 152 from bending them, particularly during erection of the posts. For example, an overlap/sleeve length 198 that is of about 10% of the height/length of the second post 152 generally provides good stability and strength without adding undue weight or length, though larger or smaller sleeve lengths 198 (i.e., overlap distances) may be suitably employed. Typically, the bottom transverse end of the second post rests atop and is supported by the cap plate 186, so the overlap length is the same as the length of the sleeve 188.

In addition, the connection-sleeve length 198 (as well as the cap-plate thickness and the first-post height) can be selected so that the connection sleeve 188 does not extend above the top of the first floor 116. For example, after installation, the top transverse end of the sleeve 188 can be at the same vertical position as (level with) the top surface of the concrete slab 116*c*, as depicted. In particular, the top transverse end of the first post 122 can be positioned below the top surface of the horizontal beam 166*a* by the thickness of the connection cap plate 184, so that the top surface of the cap plate 184 is at the same vertical position as the top surface of the horizontal beam 166*a*, with the concrete slab thickness 116*d* the same as the connection-sleeve length 198, as depicted. Other configurations and sleeve lengths can be used with good results.

It should be noted that in this embodiment the size of the first-post upper portion 146 and the size of the second-post lower portion 154 are not dependent on each other. That is, the second-post lower portion 154 need not have an outer dimension that is slightly less than an inner dimension of the first-post upper portion 146, as the two parts do not connect together in an overlapping telescopic arrangement. So the first-post upper portion 146 and the connection sleeve 188 can be of the same size (e.g., 3½" square) and the second-post lower portion 154 can be smaller (e.g., 3" square) for providing the overlapping telescopic fit. In other embodiments, the first and second posts have the same size and the sleeve has a larger size than either. And in yet other embodiments, the sleeve has a smaller size than the first-post upper portion (e.g., see FIGS. 10-11 and 12-13).

In another aspect, the invention relates to a method of constructing a multistory building using a stacking post system such as the system 110 described above or those described below. The method includes erecting the first post 122, for example as described for the first embodiment above. The first post 122 can be braced in place until the floor above it is completed. In the depicted embodiment, the connection 184 is provided as a separate component, so the method next includes attaching the connection 184 to the top of the first post 122 after the first post is erected on site. Then the second post 152 is erected by lifting it and sliding its lower portion 154 into an overlapping telescopic arrangement engaging the connection telescopic member 188, for example by being received into a connection sleeve telescopic member. The horizontal beams 116*a* are attached to the first posts 122 as may be desired. The process is repeated based on the number of posts and floors, as described above and as understood in the art.

In other embodiments, the connection 184 is attached to the top of the first post 122 during fabrication off-site, so these components are provided as one part to the site, in which case erecting the first post 122 also installs the respective connection 184. In yet other embodiments, the cap plate 186 and the telescopic member 188 of the connection 184 are provided as separate components, in which case the method includes attaching the cap plate 186 to the first post 122 and attaching the telescopic member 188 to the cap plate 186 on site.

Figure 10:
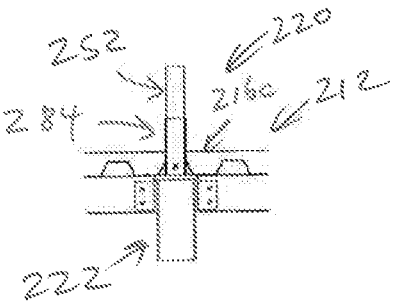
FIG. 10 is an elevation view of a portion of a multistory building constructed of a system of stackable support posts or columns according to a fourth example embodiment of the invention.
Figure 11:
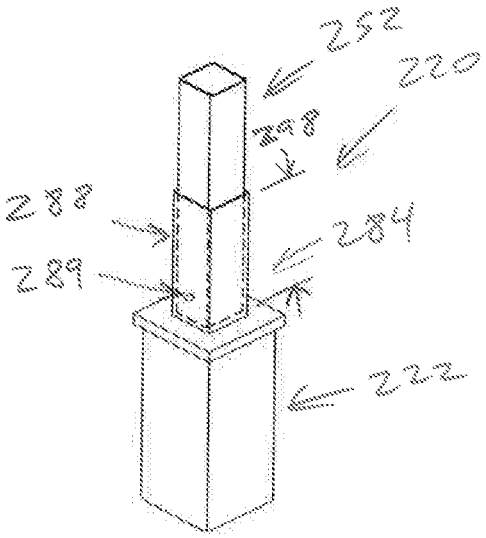
FIG. 11 is a perspective detail view of the first and second post portions and the connection of FIG. 10 all assembled together.

FIGS. 10-11 show a portion of a multistory building 212 constructed of a system 210 of stackable support posts 222 and 252 and a connection 284 according to a fourth example embodiment. The system 210 of this embodiment is similar to that of the third embodiment, with common aspects not repeated for brevity, and with differences explained in detail below.

In this and other embodiments, the length 298 of the connection sleeve 288 is longer to provide a longer overlap and thus greater structural strength for heavier posts. For example, the sleeve 288 as depicted extends above the top surface of the concrete slab 216*c*. In addition, in this and other embodiments, the sleeve 288 includes a weep or drain opening located adjacent the bottom transverse end of the second post 252. For example, the weep opening can be provide by a ½" hole positioned ¾" above the bottom end of the second post 252.

Figure 12:
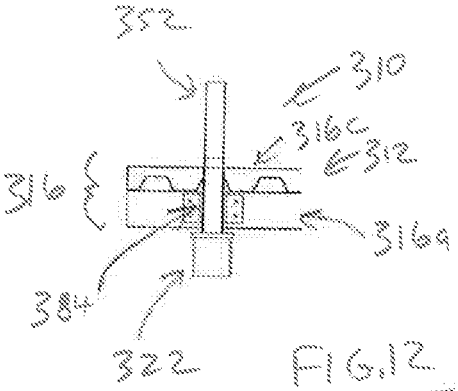
FIG. 12 is an elevation view of a portion of a multistory building constructed of a system of stackable support posts or columns according to a fifth example embodiment of the invention.
Figure 13:
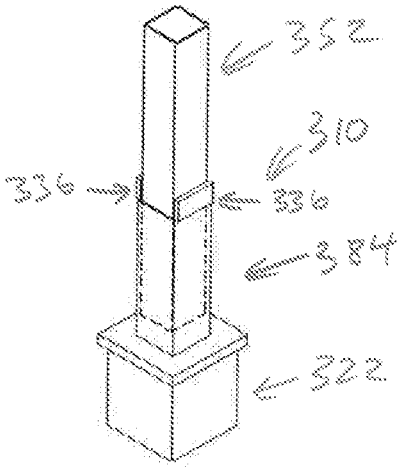
FIG. 13 is a perspective detail view of the first and second post portions and the connection of FIG. 12 all assembled together.

FIGS. 12-13 show a portion of a multistory building 312 constructed of a system 310 of stackable support posts 322 and 352 and a connection 384 according to a fifth example embodiment. The system 310 of this embodiment is similar to that of the third and fourth embodiments, with common aspects not repeated for brevity, and with differences explained in detail below.

In this and other embodiments, the first post 322 is provided with a length selected so that after construction its top transverse end is installed below the horizontal beams 316*a* of the second floor 316, and thus the construction method includes attaching the beams 316*a* to the sleeve or other telescopic member 388 of the connection 384. This embodiment provides the benefit of the sleeve 388 having a greater length for strength but not extending above the concrete slab 316*c* (e.g., with a sleeve length of about the same as or greater than the height/thickness of the floor 316, as depicted).

In addition, one or more retainers 336 may be installed for engaging and supporting the second post 352 by the connection 384. The retainers 336 can be of the same or similar type as those described above with respect to the first and embodiments. In embodiments with the retainers 336, the second post 352 can be supported by the retainers 336 at a position with its bottom end above and thus not resting on the cap plate 186, as depicted.

In other embodiments, instead of the connection including a vertical sleeve that overlaps with and telescopically receives the lower portion of the second post, in a vice versa arrangement, the connection includes a vertical plug or other male member that overlaps with and is telescopically received within a bore of the lower portion of the second post. In all embodiments, however, the connection includes a vertical member that overlaps with the lower portion of the second post in a telescopic arrangement. And in all embodiments, the horizontal cap plate isolates any water intrusion from draining into the first post.

In yet other embodiments, instead of the cap plate attaching to the top transverse end of the first post, a second/lower sleeve is provided that extends downward from the bottom surface of the cap plate and that has a bore that is sized and shaped to overlap with and telescopically receive the upper portion of the first post.

Accordingly, in various aspects the invention may include steelwork (e.g., vertical posts and connections) for a multistory building, methods of constructing multistory buildings using such steelwork, and/or resulting multistory buildings erected using the steelwork and methods. Also, it should be noted that each of the individual features of each embodiment can be included by itself or in combination with any other feature(s) to provide additional embodiments of the invention (e.g., the fifth embodiment can include weep holes or the third embodiment can include retainers).

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be limiting of the claimed invention. For example, as used in the specification including the appended claims, the singular forms "a," "an," and "one" include the plural, the term "or" means "and/or," and reference to a particular numerical value includes at least that particular value, unless the context clearly dictates otherwise. Any dimensions are representative for illustration purposes and not limiting of the invention. In addition, any methods described herein are not intended to be limited to the sequence of steps described but can be carried out in other sequences, unless expressly stated otherwise herein.

While the invention has been shown and described in exemplary forms, it will be apparent to those skilled in the art that many modifications, additions, and deletions can be made therein without departing from the spirit and scope of the invention as defined by the following claims.

What is claimed is:

1. A stacking support post system for constructing a multistory building, comprising:

at least one first post having a lower portion and an upper portion, the lower portion for positioning at a first floor of the building, the upper portion for positioning at a second floor of the building, the upper portion having a bore defined therein;

at least one second post having a lower portion and an upper portion, the lower portion for positioning at the second floor of the building, the lower portion having a bore defined therein, the upper portion for positioning at a third floor or a top structure of the building; and a connection including a cap plate and a telescopic member extending upward from the cap plate, the cap plate configured to cover the bore of the upper portion of the first post when mounted atop the first post to form a barrier to prevent water from draining from the second-post lower-portion bore into the first-post upper-portion bore, and the telescopic member configured to engage the second-post lower portion in an overlapping, telescopic arrangement, wherein the connection mounts the second post to the first post.

2. The stacking support post system of claim 1, wherein the second-post lower portion is positioned atop and supported by the cap plate when the telescopic member and the second-post lower portion are in the overlapping, telescopic arrangement.

3. The stacking support post system of claim 1, further comprising at least one retainer that abuts the telescopic member to support the second post.

4. The stacking support post system of claim 3, wherein the at least one retainer supports the second post above the cap plate.

5. The stacking support post system of claim 1, wherein the second floor of the building includes at least one horizontal beam adapted for attachment to the first-post upper portion.

6. The stacking support post system of claim 5, wherein the second floor of the building includes a concrete slab, and wherein a top end of the sleeve is generally coplanar with a top surface of the concrete slab.

7. The stacking support post system of claim 1, wherein the second floor of the building includes at least one horizontal beam that attaches to the connection telescopic member with the first-post upper portion positioned therebelow.

8. The stacking support post system of claim 1, wherein the second floor of the building includes a concrete slab, and wherein a top end of the sleeve is generally coplanar with a top surface of the concrete slab.

9. The stacking support post system of claim 1, wherein the second floor of the building includes a concrete slab, and wherein a top end of the sleeve is positioned above a top surface of the concrete slab.

10. The stacking support post system of claim 1, wherein the second-post lower portion has a weep opening formed therein.

11. A multistory building constructed of the stacking support post system of claim 1.

12. The stacking support post system of claim 1, wherein the first and second posts are rectangular steel tubes.

13. The multistory building of claim 1 constructed of and in combination with the stacking support post system of claim 1.

14. A method for constructing the multistory building of claim 1 using the stacking support post system of claim 1, comprising the steps of:

lifting the at least one first post onto the first floor of the building;

mounting the connection atop the first post if the first post was not provided with the connection pre-mounted to it;

attaching the second floor to the first-post upper portion or to the connection mounted atop the first post;

lifting the second post onto the second floor;

sliding the lower portion of the second post down into an overlapping, telescopic arrangement with the telescopic member of the connection; and installing the third floor or the building top structure at the upper portion of the second post.

15. The stacking support post system of claim 1, wherein the cap plate is attached to and supported by the first-post upper portion.

16. A stacking support post system for constructing a multistory building, comprising:

at least one first post having a lower portion and an upper portion, the lower portion for positioning at a first floor of the building, the upper portion for positioning at a second floor of the building, the upper portion having a bore defined therein:

at least one second post having a lower portion and an upper portion, the lower portion for positioning at the second floor of the building, the upper portion for positioning at a third floor or a top structure of the building; and a connection including a cap plate and a telescopic member extending upward from the cap plate, the cap plate configured to cover the bore of the upper portion of the first post when mounted atop the first post to prevent water from draining from the second post into the first-post upper-portion bore, and the telescopic member configured to engage the second-post lower portion in an overlapping, telescopic arrangement, wherein the connection mounts the second post to the first post, wherein the second-post lower portion has an outer dimension, the connection telescopic member is in the form of a sleeve having a bore defined therein with an inner dimension, and the sleeve-bore inner dimension is slightly larger than the second-post lower-portion outer dimension so that the second-post lower portion is slidingly receivable within the connection sleeve in the overlapping, telescopic arrangement.

17. A stacking support post system for constructing a multistory building, comprising:

at least one first hollow post having a lower portion and an upper portion, the lower portion for positioning at a first floor of the building, the upper portion for positioning at a second floor of the building, the upper portion having a bore defined therein;

at least one second hollow post having a lower portion and an upper portion, the lower portion for positioning at the second floor of the building, the lower portion having a bore defined therein, the upper portion for positioning at a third floor or a top structure of the building; and a connection including a cap plate and a sleeve member extending upward from the cap plate, the cap plate configured to cover the bore of the upper portion of the first post when mounted atop the first post to form a barrier to prevent water from draining from the second-post lower-portion bore into the first-post upper-portion bore, and the sleeve member configured to engage the second-post lower portion in an overlapping, telescopic arrangement, wherein the connection mounts the second hollow post to the first hollow post but prevents water from draining through the connected first and second hollow posts.

18. The stacking support post system of claim 15, wherein the wherein the second-post lower portion has an outer dimension, the connection telescopic member is in the form of a sleeve having a bore defined therein with an inner dimension, and the sleeve-bore inner dimension is slightly larger than the second-post lower-portion outer dimension so that the second-post lower portion is slidingly receivable within the connection sleeve in the overlapping, telescopic arrangement.

* * * * *